United States Patent [19]

Borenstein et al.

[11] 4,253,299

[45] Mar. 3, 1981

[54] BULKED AND ENTANGLED MULTIFILAMENT THERMOPLASTIC YARN

[75] Inventors: David E. Borenstein, Greenville, S.C.; Jack A. Banning, Rocky Mount, N.C.

[73] Assignee: Phillips Petroleum Company, Bartlesville, Okla.

[21] Appl. No.: 35,586

[22] Filed: May 3, 1979

Related U.S. Application Data

[62] Division of Ser. No. 838,799, Oct. 3, 1977, Pat. No. 4,164,841.

[51] Int. Cl.[3] ..... D02G 3/26; D02G 3/34

[52] U.S. Cl. ..... 57/246; 28/252; 28/271; 57/208; 57/206

[58] Field of Search ..... 57/246, 248, 350, 9, 57/204, 205, 206, 208, 209, 243, 283, 289, 298, 311, 908; 28/252, 271

[56] References Cited

U.S. PATENT DOCUMENTS

| | | | |
|---|---|---|---|
| 2,831,748 | 4/1958 | Finlayson | 57/248 X |
| 3,142,147 | 7/1964 | Betsch | 57/248 |
| 3,389,444 | 6/1968 | Fletcher | 57/908 X |
| 3,422,615 | 1/1969 | Norman | 57/248 X |
| 3,616,633 | 11/1971 | Chevalier-Seyvet et al. | 57/248 X |
| 4,070,815 | 1/1978 | Negishi et al. | 57/908 X |
| 4,100,725 | 7/1978 | Magel | 57/248 X |
| 4,152,886 | 5/1979 | Nelson | 57/208 |

*Primary Examiner*—Donald Watkins

[57] ABSTRACT

A bulked and entangled multifilament thermoplastic yarn and an improved process for the formation thereof which, when tufted into a fabric, presents a grass-like appearance. The yarn is made by melt spinning and water quenching filaments of a melt spinnable synthetic organic thermoplastic polymer, such as polypropylene, in a continuous process, drawing the filaments, imparting bulk and entanglement in a fluid jet entangling mechanism and taking up the thus entangled yarn on a yarn winder. Also disclosed is an improved fluid jet entangling mechanism employed in the process.

10 Claims, 9 Drawing Figures

BULKED AND ENTANGLED MULTIFILAMENT THERMOPLASTIC YARN

This application is a division of copending application Ser. No. 838,799, filed Oct. 3, 1977, now U.S. Pat. No. 4,164,841.

The present invention relates generally to the formation of multifilament thermoplastic yarn, and more particularly to the continuous formation of bulked and entangled grass-like thermoplastic yarn.

In the preparation of fibers from fusible polymers, it is customary to force the molten polymer through the orifices of a spinneret into a region where the temperature is lower than the temperature of the molten polymer. In the cooler region, the molten polymer sets up into filaments sufficiently firm to be drawn away continuously by a yarn forwarding device. Conventionally, the molten polymer is spun through a spinneret having orifices spaced from each other by relatively large distances in order to keep newly formed filaments separated until they have congealed sufficiently to prevent their sticking together or coalescing. Productivity of yarn per spinneret under these conditions is low, even at the highest practicable speeds of windup. Increased spinneret size can be achieved only to a limited extent due to the high pressures in the melt extrusion.

A second disadvantage of prior melt-spinning practices concerns the difficulty of coupling the steps in yarn preparation. After a filament is spun, drawing is generally necessary in order to raise the mechanical properties of the filaments to an acceptable level. However, filament input to the drawing step usually proceeds at a rate necessarily different from the rate of filament output from the spinning step. For example, it may be necessary to draw the filament at a much lower rate than it is desirable to spin the filament. Under such conditions it is most efficient to interrupt the process of the yarn preparation, that is, to package the yarn temporarily after the spinning step for subsequent use in the drawing step. Even when it is possible to draw the yarn at a sufficiently rapid rate to allow its being used directly from the spinning step, the rate of yarn travel at the output from the drawing step often exceeds the capacity of the currently available yarn-handling equipment.

An object of the present invention is to provide a novel bulked and entangled multifilament yarn.

One other object of the present invention is to provide a new method for producing bulked and entangled multifilament yarn.

Another object of the present invention is to provide new apparatus for the continuous production of bulked and entangled multifilament thermoplastic yarn.

A further object of the present invention is to provide an improved fluid jet entangler mechanism for use in new method and apparatus for the continuous production of bulked and entangled multifilament thermoplastic yarn.

These and other objects, advantages, details and embodiments of the present invention will become apparent to one skilled in the art from the following detailed description and accompanying drawings of the invention as well as the appended claims.

In accordance with the present invention it has been discovered that by extruding a melt-spinnable thermoplastic material in molten form through a spinneret die to form a plurality of filaments, quenching the filaments in a quenching fluid, drawing the quenched filaments, and entangling the quenched and drawn filaments to impart bulk and entanglement thereto, a grass-like yarn having both bulk and entanglement can be formed in a continuous process. In another aspect, there is provided in the present invention novel apparatus for the continuous formation of bulked and entangled multifilament thermoplastic yarn. Still another aspect of the present invention resides in the provision of various embodiments of a filament jet entangler for use in the formation of bulked and entangled multifilament yarn.

The present invention is illustrated in the accompanying drawings in which.

Figure 1:
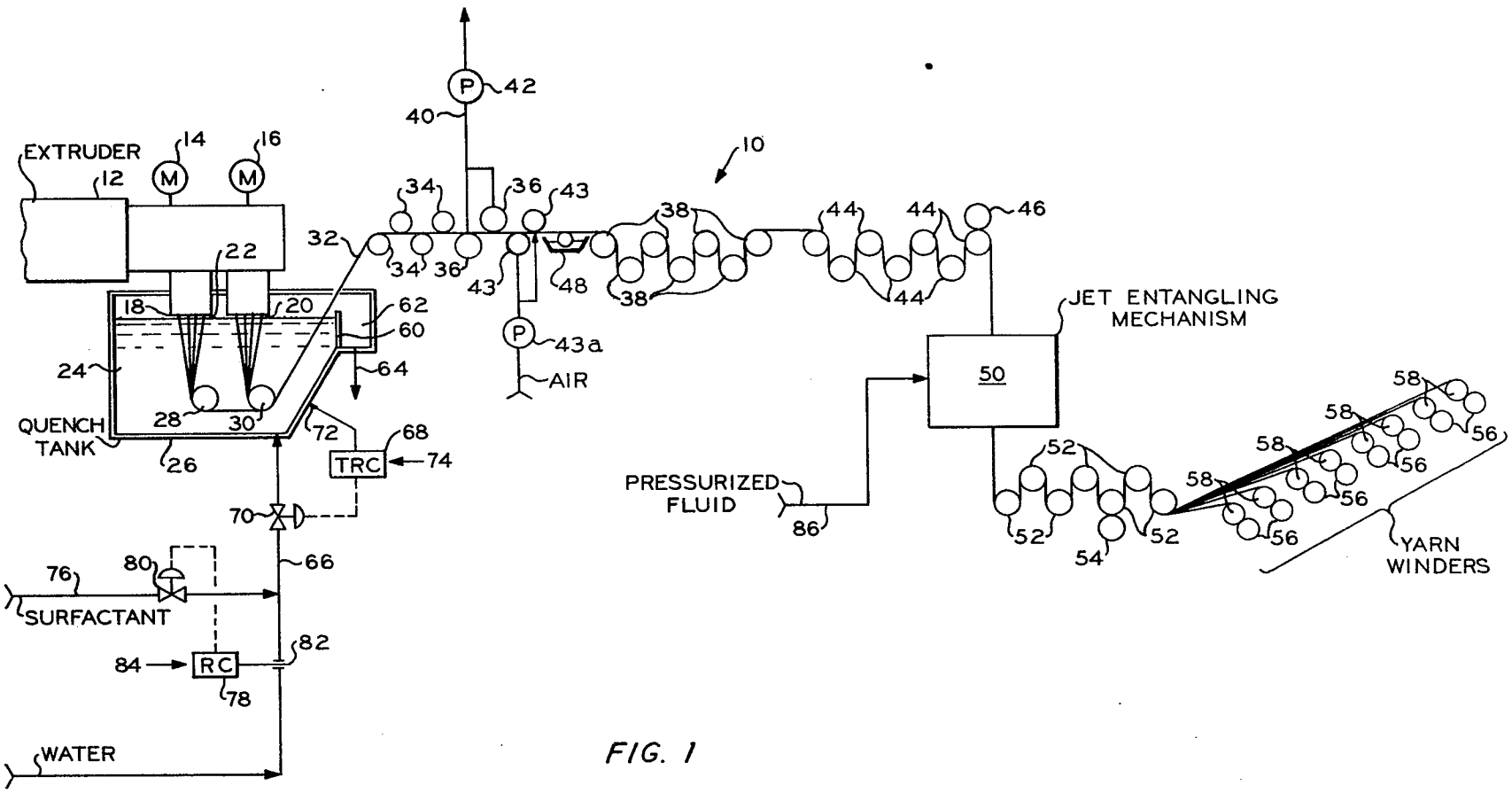
FIG. 1 is a diagrammatical representation of a system for continuously forming bulked and entangled multifilament thermoplastic yarn.

Referring now to the drawings, and to FIG. 1 in particular, a system for continuously forming bulked and entangled multifilament thermoplastic yarn is illustrated therein and is generally designated by the reference character 10. A melt-spinnable synthetic organic thermoplastic polymer, for example a polyamide, a polyester, a polyhydrocarbon such as a polyolefin, or a copolymer thereof, or other fiber-forming polymer, but preferably polypropylene, is converted to its molten form in an extruder 12 by a combination of external heat and generated heat caused by shear action, and is passed through separate passageways to two melt spin metering pumps driven by motors 14 and 16. The polymer can be blended with suitable pigments, stabilizers, antioxidants, delusterants, dye additives, antistatic materials or other suitable additives. Molten polymer is passed at a metered rate from the metering pumps through screen packs to and through the spinneret die plates 18 and 20 to form a plurality of filaments at each die plate. The temperature of the extruded melt will generally be in the range of about 204° C. to about 343° C., and for polypropylene, the temperature will generally be in the range of about 232° C. to about 301° C. The extruder pressure will generally be in the range of about 1000 psi (70.31 Kg/sq.cm) to about 2000 psi (140.62 Kg/sq.cm). The spinning speed can be increased by using smaller spinning orifices, increasing the temperature of the quench liquid, and/or increasing the melt temperature accompanied by increasing the output rate per spinneret orifice by changing speed of the metering pumps.

The filaments from the spinneret die plates 18 and 20 pass through an air gap 22 into a body of quench liquid 24, such as water, maintained in a quench tank 26. The filaments from spinneret die plate 18 pass around a stationary guide pin 28 to a second stationary guide pin 30. Filaments from spinneret die plate 20 pass around the guide pin 30 and can be combined with the filaments from spinneret die plate 18 to form a tow or filament bundle. Alternatively, the filaments from the die plates 18 and 20 can be divided to form a plurality of filament bundles or tows. In the present invention it will be understood that the filaments are divided into eight filament bundles or tows which will be generally designated in the aggregate by the reference character 32. The filaments or tows 32 are withdrawn from the quench tank 26 and passed through a tension ladder comprising stainless steel bars 34 and slotted pipes 36. The tension bars 34 create a constant tension source for the feed or retarding rolls 38 to pull against, and further serve to remove some quench liquid from the surfaces of the filaments and align the filaments in a substantially horizontal band to go through the feed rolls 38 evenly. The pipes 36, which have transverse slots therein, are connected via line 40 to a vacuum pump 42 to remove excess quench liquid from the filaments. Additional slotted pipes 43 are disposed on opposite sides of the filaments 32 and are connected to an air pump 43*a* whereby each slotted pipe directs a wall of air across the filaments. The wall of air is preferably directed at an angle in the range of about 10° to about 45° from a plane perpendicular to the filaments and opposite to the direction of movement of the filaments.

The first set or stand of feed or retarding rolls 38 are positively driven at a uniform constant rate to pull the filaments out of the quench bath and through the tension ladder. The rolls 38 also serve as a restraining device for a second set or stand of positively driven draw rolls 44. Each of the draw rolls 44 is preferably heated, by suitable means such as steam or electrical heaters. A suitable temperature for the rolls 44 is in the range of about 82° to about 130° C., with a preferable temperature being approximately 127° C. Heating the rolls 34 serves the dual purposes of completing the drying of the filaments and heating the filaments to facilitate further conditioning in subsequent operations. A nip roll 46 rollingly engages the filaments as they pass over the last draw roll 44 in the second stand.

The draw rolls 44 act in concert with the feed rolls 38 to draw the filaments of the tows 32. The filaments are drawn generally to a draw ratio within the range of about 2.5 to about 3.6. It is presently preferred to draw the filaments to a draw ratio of approximately 3.0. A roll-type or other suitable type finish applicator 48 can be installed between the slotted pipes 43 and the feed rolls 38. It will be understood, however, that the finish applicator can be installed elsewhere in the line as conditions may require.

The drawn and quenched filaments of the tows 32 are passed from the second stand of draw rolls 44 into a jet entangling mechanism 50. The jet entangling mechanism 50 comprises one or more filament jet entanglers, as will be described in detail hereafter, corresponding in number to the number of ends or tows of yarn passing through the jet entangling mechanism. The filaments of the tows 32 are suitably entangled, as diagrammatically shown in FIG. 8, in the jet entangling mechanism 50 to impart the desired bulk and entanglement thereto as they continuously pass through the mechanism. Entanglement is achieved by the penetration of laterally oriented filament loops between other filaments of the yarn end or tow. The loops can be open and/or crunodal depending on the desired degree of entanglement, a yarn of low filament entanglement having substantially fewer loops for a given length than a yarn of high filament entanglement.

The quenched, drawn and entangled filaments of the tows 32 are then withdrawn from the jet entangling mechanism 50 in the form of bulked and entangled yarn. The bulked and entangled yarn is then passed to a third stand comprising a plurality of second feed rolls 52 which engage and withdraw the yarn of the tows 32 from the jet entangling mechanism 50. A nip roll 54 rollingly engages one of the feed rolls 52 and the yarn passing therebetween. The feed rolls 52 are positively driven, as are the draw rolls 44 and their relative speeds are suitably adjusted to provide a tension on the tows 32 downstream of the jet entangling mechanism 50 in the range of about 125 to about 225 grams.

The tows 32 are passed from the third stand of feed rolls 52 to one or more yarn winders 56, preferably of the constant tension type, corresponding in number to the number of tows or ends of yarn being formed. In a presently preferred embodiment, eight yarn ends are processed on the system 10 thus permitting the simultaneous formation of eight yarn packages 58 on eight winders 56.

Figure 9:
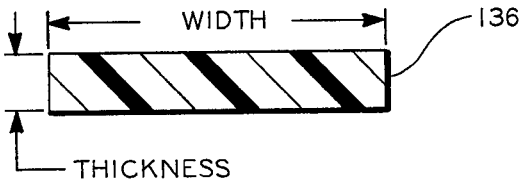
FIG. 9 is an enlarged cross-sectional view of a filament of a yarn produced in accordance with the present invention.

The length of the air gap 22 extending from the faces of the spinnerets 18 and 20 to the upper surface of the body of quench liquid 24 has been found to be critical when processing a high population density of filaments from the spinnerets. In general, the gap 22 should be one-half inch in length or less and is preferably approximately one-quarter inch. In a presently preferred embodiment each of the die plates 18 and 20 is provided with 136 orifices each of rectangular cross section with a length to width ratio of approximately 6 to 1. Each orifice provides a filament having a rectangular cross section, as shown in FIG. 9, with a width-to-thickness aspect ratio of approximately 6 to 1. Each die plate provides filaments for four yarn ends or tows of 34 filaments each.

The length of the air gap 22 can be controlled by utilizing an adjustable weir 60 to separate the main portion of the quench tank 26 from an overflow section 62. A drain line 64 is connected to the bottom of the overflow section 62. Instead of or in addition to an adjustable weir or its equivalent, means can be provided to effect relative movement between the quench tank 26 and the spinnerets. A liquid level controller can be employed to maintain a desired level of quench liquid. If desired, the air gap 22 can be filled with an inert gas, for example, nitrogen, instead of air. Makeup quench liquid is passed through a conduit 66 into the quench tank 26. The temperature of the quench liquid in the tank 26 can be maintained substantially constant by a temperature recorder controller 68 manipulating a valve 70 located in the conduit 66 responsive to a comparison of the actual temperature of the quench liquid as indicated by a temperature sensor 72 and the desired quench temperature represented by set point 74 on the controller 68. The quench tank 26 can be provided with baffles, if desired, to minimize circulating currents and vibrations. The makeup quench liquid can be tap water at the available temperature or water which has been cooled or heated as desired.

It has been found that the surface tension of the quench liquid becomes a significant factor with high filament population densities. With a filament population density of at least 25 spinning orifices per square inch of the effective spinning area it is desirable that the surface tension be maintained below 65 dynes per centimeter. With a filament population density of at least 40 spinning orifices per square inch of effective spinning area, it is presently preferred that the surface tension of the quench liquid be maintained below 55 dynes per centimeter. To provide greater assurance of preventing marriage of adjacent filaments, to provide a greater margin of safety and to reduce the accuracy required, it has been found desirable to generally maintain the surface tension of the quench liquid below about 40 dynes per centimeter. A surface tension over 65 dynes per centimeter is sufficient at high filament population densities to cause lateral movement of the filaments in the air gap to the point where adjacent filaments adhere to each other. The lateral movement also tends to introduce nonuniform stresses in the filaments. With a short air gap, a high surface tension can result in sufficient deformation of the liquid surface to cause contact of the quench liquid with the spinneret or sufficient proximity for the radiant heat to induce localized boiling. While it is possible to reduce the surface tension of the quench liquid by raising the temperature thereof, operation at higher quench temperatures increases the risk of localized boiling either by radiant heat from the spinneret or by conduction from the filaments entering the quench liquid. Accordingly, the presently preferred practice is to use a surfactant to decrease the surface tension. The surfactant can be passed through a conduit 76 into the conduit 66 wherein it is admixed with the quench liquid. The rate of addition of the surfactant can be controlled by a ratio controller 78 manipulating a valve 80 interposed in the conduit 76 responsive to the flow rate of quench liquid through the conduit 66 as indicated by a flow sensor 82 and the desired ratio of surfactant to quench liquid as represented by an input 84 to the ratio controller 78. A metering pump can be used instead of the valve 80. It has also been found that the use of a surfactant in the quench water aids in the removal of the water from the filament bundle or bundles as they pass through the tension ladder bars 34 and slotted pipes 36.

Figure 2:
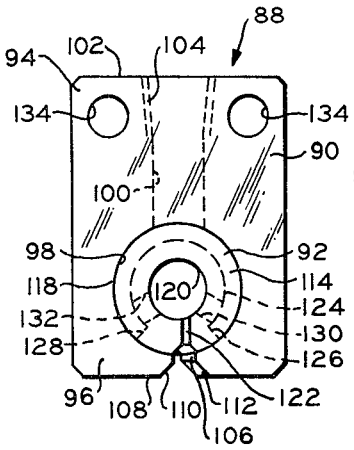
FIG. 2 is a top plan view of a preferred embodiment of a filament jet entangler for use in the formation of bulked and entangled multifilament yarn.
Figure 3:
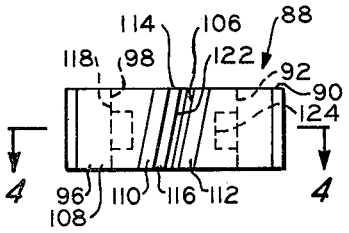
FIG. 3 is a front elevation view of the filament jet entangler of FIG. 2.
Figure 4:
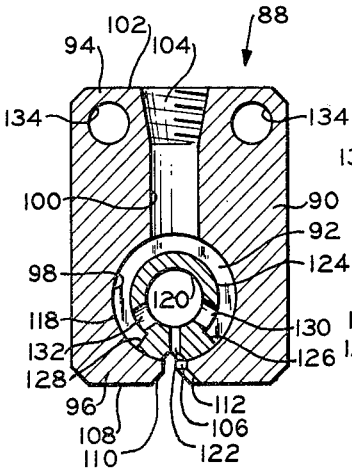
FIG. 4 is a cross-sectional view taken along line 4—4 of FIG. 3.

The jet entangling mechanism 50 comprises one or more filament jet entanglers suitably connected to a source of pressurized fluid via a suitable conduit 86. A preferred embodiment of filament jet entangler constructed in accordance with the present invention is illustrated in FIGS. 2, 3, and 4 and is generally designated by the reference character 88. The entangler 88 comprises a supporting bracket 90 and a jet insert 92 mounted in the supporting bracket.

The supporting bracket 90 has first and second opposite end portions 94 and 96. A transverse bore 98 is formed in the bracket 90 proximate the second end portion 96 thereof. A fluid passage 100 communicates between a first end face 102 in the first end portion 94 and the substantially cylindrical wall of the bore 98. Internal threads 104 are formed in the fluid passage 100 to provide means for connecting the fluid passage to the conduit 86 connected to the source of pressurized fluid. A stringup slot 106 is formed in the second end portion 96 and communicates between the transverse bore 98 and the second end face 108 of the bracket. The slot 106 preferably includes chamfered edges 110 and 112 which intersect the end face 108. The slot 106 is preferably inclined at an angle of approximately 10 degrees to the axis of the bore 98 as viewed in FIG. 3.

The jet insert 92 is provided with upper and lower end faces 114 and 116 and has a substantially cylindrical outer surface 118 extending therebetween. A substantially cylindrical yarn confining passage 120 extends through the jet insert in coaxial alignment with the outer surface 118 and communicates between the upper and lower end faces 114 and 116. The diameter of the outer surface 118 is sized to be closely received within the transverse board 98 of the supporting bracket to tightly secure the jet insert therein.

The jet insert 92 is further provided with a stringup slot 122 communicating between the outer surface 118 and the passage 120. The slot 122 is preferably inclined at an angle of approximately 10 degrees to the axis of the yarn confining passage 120 and is positioned in registration with the slot 106 of the supporting bracket when the jet insert is properly installed therein. It will be seen that the slot 122 extends the full length of the jet insert.

An interrupted circumferential groove 124 is formed in the outer surface 118 of the jet insert intermediate the upper and lower end faces 114 and 116, with the opposite ends 126 and 128 terminating respectively proximate to the slot 122. A pair of fluid jet ports or nozzles 130 and 132 each communicate between the groove 124 and the yarn confining passage 120. The ports 130 and 132 are preferably aligned such that their respective axes intersect the axis of the yarn confining passage 120. Further, it is preferred that the axes of the ports 130 and 132 are aligned perpendicular or normal to the axis of the passage 120. It is further preferred that the axes of the ports 130 and 132 lie in a common plane. It should be noted, however, that other alignments of the ports 130 and 132 relative to the yarn confining passage 120 may be employed under certain conditions. The angle between the coplanar axes of the jet ports 130 and 132 define an included angle in the range of about 60 degrees to about 179 degrees. In a presently preferred embodiment, the included angle is approximately 120 degrees.

The diameters of the yarn confining passage 120 and the jet ports 130 and 132 are preferably selected such that the cross sectional area of the yarn confining passage 120 is within the range of about 2 to about 3 times the total cross sectional area of the fluid jet ports 130 and 132. This size relationship has been found to provide optimum entanglement of filaments passing through the filament jet entangler 88. Similarly, the preferred included angle between the jet ports 130 and 132 has been found to provide optimum entanglement of filaments under certain conditions. It should be understood that the fluid passage 100 in the supporting bracket 90 communicates with the interrupted circumferential groove 124 in the jet insert 92 to provide a suitable conduit through the filament jet entangler 88 from the source of pressurized fluid to the yarn filaments passing through the yarn confining passage 120. The stringup slots 106 and 122 in the supporting bracket and jet insert provide convenient means for initially stringing filaments in the filament jet entangler 88. In a preferred embodiment, the minimum width of the slots 106 and 122 is approximately 0.66 millimeters although other widths may be employed for various sizes and numbers of filaments in a tow. The supporting bracket 90 is preferably provided with means for securely mounting the filament jet entangler 88 to a supporting structure, suitable means being a part of bolt holes 134 formed in the first end portion 94 of the supporting bracket.

Figure 5:
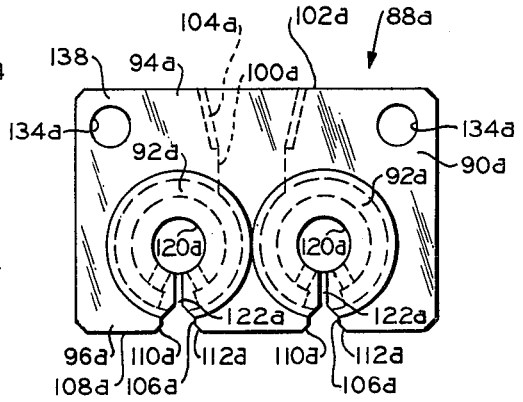
FIG. 5 is a top plan view of an alternate embodiment of a filament jet entangler constructed in accordance with the present invention.
Figure 6:
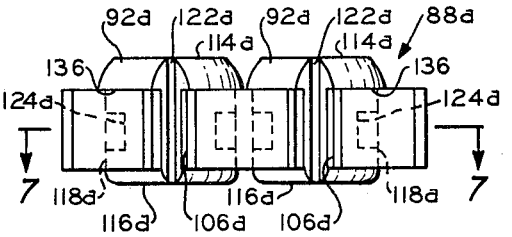
FIG. 6 is a front elevation view of the filament jet entangler of FIG. 5.
Figure 7:
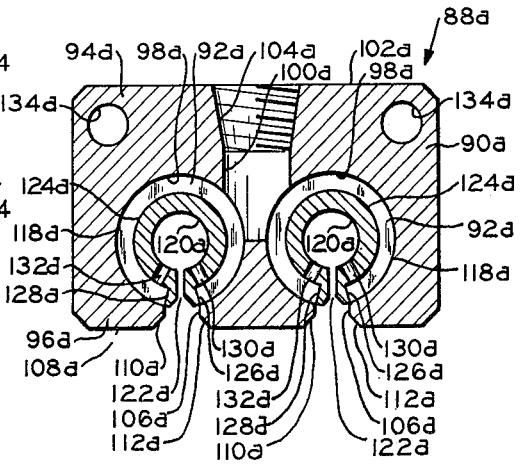
FIG. 7 is a cross-sectional view taken along line 7—7 of FIG. 6.

An alternate embodiment of a filament jet entangler constructed in accordance with the present invention is illustrated in FIGS. 5, 6 and 7 and is generally designated by the reference character 88*a*. The entangler 88*a* comprises a supporting bracket 90*a* and a pair of slightly modified jet inserts 92*a*.

The supporting bracket 90*a* is provided with first and second end portions 94*a* and 96*a* with a pair of transverse bores 98*a* formed therein proximate to the second end portion 96*a*. A blind fluid passage 100*a* is formed in the supporting bracket and intersects the first end face 102*a* on the first end portion 94*a* thereof. The passage 100*a* communicates with both transverse bores 98*a* intermediate the opposite ends thereof. The passage 100*a* is provided with suitable internal threads 104*a* to provide means for connection of the passage 100*a* with the conduit 86 which in turn communicates with the source of pressurized fluid. A pair of stringup slots 106*a* communicates respectively between the bores 98*a* and the second end face 108*a* of the supporting bracket. Each of the slots 106*a* is preferably provided with chamfered edges 110*a* and 112*a*.

Each of the jet inserts 92*a* is provided with upper and lower end faces 114*a* and 116*a* with a substantially cylindrical outer surface 118*a* extending upwardly from the lower end face 116*a* and with a substantially cylindrical yarn confining passage 120*a* communicating and extending between the respective upper and lower end faces 114*a* and 116*a*. The outer surface 118*a* of each jet insert 92*a* intersects a radially outwardly extending circumferential shoulder 136. A stringup slot 122*a* is formed in each jet insert 92*a* and communicates between the respective yarn confining passage 102*a* and outer surface 118*a* and shoulder 136 of the respective jet insert. Each slot 122*a* preferably includes a pair of chamfered edges communicating with the respective outer surface 118*a* and circumferential shoulder 136. Each slot 122*a* is, in this embodiment, preferably aligned in parallel relation to the axis of the corresponding yarn confining passage 120*a*. Similarly, each slot 106*a* is preferably in parallel alignment with the corresponding transverse bore 98*a* of the supporting bracket 90*a*.

Each of the jet inserts 92*a* is provided with an interrupted circumferential groove 124*a* formed in the substantially cylindrical outer surface 118*a* with the opposite ends 126*a* and 128*a* thereof terminating respectively proximate to the slot 122*a*. A pair of fluid jet ports or nozzles 130*a* and 132*a* communicate between the groove 124*a* and the yarn confining passage 120*a* with the axes of the jet ports preferably lying in a common plane which plane is normal to the axis of the passage 120*a*. The coplanar axes of the ports 130*a* and 132*a* define an included angle therebetween in the range of about 60 degrees to about 179 degrees with a preferred included angle of approximately 60 degrees. The ports 130*a* and 132*a* and the passage 120*a* are preferably sized such that the cross sectional area of the passage 120*a* is in the range of about two to about three times the total cross sectional area of the fluid jet ports 130*a* and 132*a*. The minimum width of the slot 122*a* in each jet insert 92*a* is preferably approximately 0.30 millimeters although other widths may be employed for various sizes and numbers of filaments in a tow. The interrupted circumferential grooves 124*a* of each jet insert 92*a* are so positioned thereon that they communicate with the fluid passage 100*a* as shown in FIG. 7, when the circumferential shoulder 136 of each jet insert is positioned in abutting relation with the upper surface 138 of the supporting bracket 90*a*. The diameter of the substantially cylindrical outer surface 118*a* of each jet insert 92*a* is sized to be closely received within the corresponding transverse bore 98*a* of the supporting bracket to tightly secure the jet inserts in the supporting bracket with the slots 122*a* of each jet insert in registration with the corresponding slots 106*a* in the supporting bracket. Bolt holes 134*a* formed in the first end portion 94*a* of the supporting bracket 90*a* provide suitable means for securing the filament jet entangler 88*a* to a supporting structure in the system 10.

It will be understood that in the preferred embodiment of the system 10 described above, wherein eight yarn ends are simultaneously formed, eight filament jet entanglers 88 would be required while four filament jet entanglers 88*a* would be required. The various forms of fluid jet inserts described above may be formed of various materials, notable among such materials suitable with this application are various metals including stainless steel and suitable ceramic compositions. The jet entanglers 88 may be oriented in any direction with the presently preferred orientation being such that the axes of the yarn confining passages are vertical.

Figure 8:
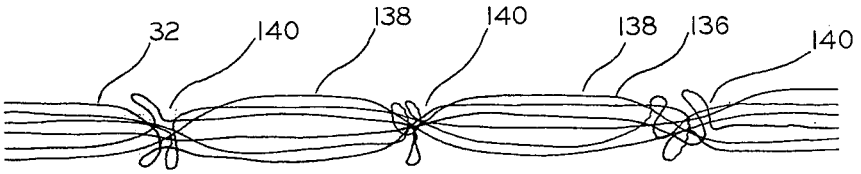
FIG. 8 is a diagrammatical illustration on a considerably enlarged scale of a yarn produced in accordance with the present invention.

In operation, the system 10 is run utilizing polypropylene as the melt-spinnable thermoplastic material. The first stand of feed rolls 38 are driven to provide a linear filament velocity of approximately 135 meters per minute. The second stand of draw rolls 44 are driven at a rate providing a linear filament velocity of approximately 405 meters per minute, while the third stand of feed rolls 52 are driven to provide a linear yarn velocity of approximately 366 meters per minute. The difference in linear velocity between the first and second stands of rolls provides a draw ratio of 3.0. The difference between the linear velocities provided by the second and third stands of rolls provides an appropriate amount of overfeed. The percent of overfeed is herein defined as the difference in linear velocity between the second roll stand and the third roll stand divided by the linear velocity of the third roll stand. Thus, there is provided a percent of overfeed of 10.6 percent which is within the preferred overfeed range for low filament entanglement of about 10 to about 13 percent. The draw rolls 44 are heated at their roll surface to a temperature of approximately 127° C. The pressurized fluid applied to the jet entangling mechanism is saturated steam at a pressure in the range of about 30 psig (2.1 Kg/sq.cm) to about 50 psig (3.5 Kg/sq.cm), and preferably approximately 35 psig (2.5 Kg/sq.cm). The quench liquid is maintained at a temperature in the range of about 23° C. to about 41° C. Each yarn end is passed through a filament jet entangler 88 as described above in which the included angle between the jet ports 130 and 132 is 120 degrees and in which the jet port diameters are approximately 4.39 millimeters and the diameter of the yarn confining passage is approximately 9.80 millimeters. The tension applied to the yarn in the entangling zone is maintained at approximately 175 grams. The process yields 4500/34 denier yarn, as shown in FIG. 8 at 32, at approximately 132 denier per filament 136 with about one to about three segments of unentangled filaments 138 of at least about 15 centimeters in length between adjacent entangled filament loops penetrating between other filaments, as shown at 140, per meter of yarn on an average basis.

By reducing the linear velocity of the filaments through the first and second stands of rolls 38 and 44 by approximately 16 percent and adjusting the linear velocity of the third stand of rolls 52 to achieve a percent of overfeed in the range of about 17 to about 20 percent, a yarn of higher entanglement, that is a yarn having no more than about one segment of unentangled filaments 138 at least about 15 centimeters in length between adjacent entangled filament loops penetrating between other filaments, as shown at 140, per five meters of yarn on an average basis is produced by the present process. The process is capable of producing grass-like yarn of continuous polypropylene filaments having substantially rectangular cross section of from about 3300/34 to 6500/34 denier, or about 97 to about 191 denier per filament.

Reasonable variations and modifications which will be apparent to those skilled in the art can be made in this invention without departing from the spirit and scope thereof.

What is claimed is:

1. A multifilament melt-spinnable plastic yarn comprising a plurality of melt-spinnable, liquid quenched plastic filaments mutually entangled by laterally oriented filaments loops penetrating between the other filaments, said filaments having a noncircular cross section; and said yarn being characterized in that there are no more than about three segments of unentangled filaments of at least about 15 centimeters in length between adjacent entangled filament loops per meter of yarn on an average basis.

2. A yarn as defined in claim 1 wherein said yarn is characterized further in that there is no more than about one segment of unentangled filaments of at least about fifteen centimeters in length between adjacent entangled filament loops per five meters of yarn on an average basis.

3. A yarn as defined in claim 1 wherein said yarn is characterized further in that there are about one to about three segments of unentangled filaments of at least about fifteen centimeters in length between adjacent entangled filament loops per meter of yarn on an average basis.

4. A yarn as defined in claim 1 wherein said melt-spinnable plastic filaments are substantially rectangular in cross section.

5. A yarn as defined in claim 1 wherein said melt-spinnable plastic filaments are substantially rectangular in cross section with an aspect ratio of width to thickness of said cross section of approximately 6 to 1.

6. A yarn as defined in claim 1 wherein said melt-spinnable plastic filaments are formed of a polymer comprising a polyolefin.

7. A yarn as defined in claim 1 wherein said melt-spinnable plastic filaments are formed of polypropylene.

8. A yarn as defined in claim 1 wherein said melt-spinnable plastic filaments are formed of extruded, liquid quenched polypropylene.

9. A yarn as defined in claim 8 or claim 1 wherein said yarn comprises filaments having about 97 to about 191 denier per filament.

10. A yarn as defined in claim 9 wherein said yarn comprises 34 filaments.

* * * * *